US010385560B2

(12) United States Patent
Shen

(10) Patent No.: US 10,385,560 B2
(45) Date of Patent: Aug. 20, 2019

(54) DEVICE FOR SPRAYING AN ENCLOSURE TRIGGERED BY INCLINATION OF A ROTATABLE LID

(71) Applicant: Conopco, Inc., Englewood Cliffs, NJ (US)

(72) Inventor: Xin Shen, Shenzhen (CN)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

(21) Appl. No.: 15/518,302

(22) PCT Filed: Sep. 8, 2015

(86) PCT No.: PCT/EP2015/070469

§ 371 (c)(1),
(2) Date: Apr. 11, 2017

(87) PCT Pub. No.: WO2016/058753

PCT Pub. Date: Apr. 21, 2016

(65) Prior Publication Data

US 2017/0254059 A1 Sep. 7, 2017

(30) Foreign Application Priority Data

Oct. 14, 2014 (EP) ..... 14188876

(51) Int. Cl.

| | |
|---|---|
| ***E03D 9/00*** | (2006.01) |
| ***A47K 13/30*** | (2006.01) |
| ***A47K 13/24*** | (2006.01) |
| ***B65F 1/14*** | (2006.01) |
| ***B65F 1/16*** | (2006.01) |
| ***B65F 7/00*** | (2006.01) |

(52) U.S. Cl.
CPC ..... *E03D 9/005* (2013.01); *A47K 13/24* (2013.01); *A47K 13/302* (2013.01); *B65F 1/1473* (2013.01); *B65F 1/16* (2013.01); *B65F 7/005* (2013.01); *B65F 2210/168* (2013.01)

(58) Field of Classification Search
CPC ..... E03D 1/003
USPC ..... 4/662
See application file for complete search history.

(56) References Cited

U.S. PATENT DOCUMENTS

| | | | |
|---|---|---|---|
| 2,605,478 | A | 8/1952 | Lassiter |
| 3,018,056 | A | 1/1962 | Montgomery |
| 3,739,944 | A | 6/1973 | Rogerson |
| 4,159,791 | A | 7/1979 | Crutcher |
| 4,235,373 | A | 11/1980 | Clark |
| 4,319,614 | A | 3/1982 | Boice |
| 5,029,736 | A | 7/1991 | Maruyama et al. |
| 5,149,506 | A | 9/1992 | Skiba et al. |
| 5,181,630 | A | 1/1993 | McNally |
| 5,249,718 | A | 10/1993 | Muderlak |
| 5,292,071 | A | 3/1994 | Kruer |
| 5,454,123 | A | 10/1995 | Barabino |
| 5,476,198 | A | 12/1995 | Jouillat et al. |
| 5,702,056 | A | 12/1997 | Yang |
| 5,906,009 | A | 5/1999 | Sakar |
| D438,979 | S | 3/2001 | Gomes et al. |
| 6,439,476 | B1 | 8/2002 | Boggs |
| 6,440,373 | B1 | 8/2002 | Gomes et al. |
| 2002/0066749 | A1 | 6/2002 | De Laforcade |
| 2002/0108952 | A1 | 8/2002 | Delman et al. |
| 2006/0065326 | A1 | 3/2006 | Shingle |
| 2006/0151548 | A1 | 7/2006 | Seris et al. |
| 2007/0034711 | A1 | 2/2007 | Kah, Jr. |
| 2007/0295767 | A1 | 12/2007 | Angelo et al. |
| 2008/0142555 | A1 | 6/2008 | Marin et al. |
| 2009/0108088 | A1 | 4/2009 | Bredberg |
| 2009/0159620 | A1 | 6/2009 | Nielsen |
| 2009/0249533 | A1 | 10/2009 | Sawalski et al. |
| 2010/0147903 | A1 | 6/2010 | Farside |
| 2012/0144569 | A1 | 6/2012 | Kodat |
| 2013/0025038 | A1 | 1/2013 | Frey et al. |
| 2013/0193225 | A1 | 8/2013 | DeWitt |
| 2013/0270361 | A1 | 10/2013 | Clark et al. |
| 2014/0061243 | A1 | 3/2014 | Goettke et al. |

FOREIGN PATENT DOCUMENTS

| | | |
|---|---|---|
| CH | 672873 | 1/1990 |
| DE | 316560 | 4/1919 |
| DE | 2851139 | 6/1980 |
| DE | 8527501 | 11/1985 |
| DE | 19908779 | 12/1999 |
| DE | 19945075 | 4/2000 |
| DE | 102011001512 | 9/2012 |
| DE | 202012002839 | 8/2013 |
| EP | 0082439 | 6/1983 |
| EP | 0194407 | 9/1986 |
| EP | 1467820 | 10/2004 |
| EP | 2071087 | 6/2009 |
| EP | 2775051 | 9/2014 |
| FR | 2411277 | 7/1979 |
| FR | 2610815 | 8/1990 |
| FR | 2669007 | 5/1992 |
| FR | 2674204 | 9/1992 |
| FR | 2868343 | 10/2005 |

(Continued)

OTHER PUBLICATIONS

IPRP in PCTEP2015072418, dated Sep. 19, 2016.

(Continued)

*Primary Examiner* — Lori Baker
(74) *Attorney, Agent, or Firm* — Greenberg Traurig, LLP

(57) ABSTRACT

A device for spraying an enclosure is provided, in particular, a device to spray a toilet bowl. The device for automatically spraying an enclosure closable by a rotatable lid, wherein the device is attachable to the lid, comprises a spraying mechanism suitable for repeatedly spraying individual doses of a cleaning liquid into the interior volume of the enclosure; and an electronic control system which includes a tilt sensor; wherein the control system is configured to detect the orientation of the device, and wherein the electronic control system is programmed to perform steps that allow enhancing the safety and/or reliability of the operation of the device. A method for operating the device is also provided.

10 Claims, 1 Drawing Sheet

(56) References Cited

FOREIGN PATENT DOCUMENTS

| | | |
|---|---|---|
| GB | 1562052 | 3/1980 |
| JP | 47008547 | 10/1972 |
| JP | 48041630 | 5/1973 |
| JP | 1130965 | 3/1989 |
| JP | 1179856 | 12/1989 |
| JP | 2048566 | 4/1990 |
| JP | 2048567 | 4/1990 |
| JP | 2066453 | 5/1990 |
| JP | 2148962 | 12/1990 |
| JP | 3053459 | 5/1991 |
| JP | 4001093 | 1/1992 |
| JP | 6003858 | 1/1994 |
| JP | 9099964 | 4/1997 |
| WO | WO9222466 | 12/1992 |
| WO | WO9424253 | 10/1994 |
| WO | WO9917650 | 4/1999 |
| WO | WO9963877 | 12/1999 |
| WO | WO0001423 | 1/2000 |
| WO | WO02084034 | 10/2002 |
| WO | WO03099452 | 12/2003 |
| WO | WO03102315 | 12/2003 |
| WO | WO2004093625 | 11/2004 |
| WO | WO2006038005 | 4/2006 |
| WO | WO2007075819 | 7/2007 |
| WO | WO2008010112 | 1/2008 |
| WO | WO2010140471 | 12/2010 |
| WO | WO2010141087 | 12/2010 |
| WO | WO2011061478 | 5/2011 |
| WO | WO2011101194 | 8/2011 |
| WO | WO2012156170 | 11/2012 |
| WO | WO2013017393 | 2/2013 |

OTHER PUBLICATIONS

Search Report in EP14188874, dated Mar. 23, 2015, EP.
Search Report in EP14188875, dated Mar. 16, 2015, EP.
Search Report in EP14188876, dated Mar. 17, 2015.
Search Report in PCTEP2015070469, dated Nov. 30, 2015.
Search Report in PCTEP2015072315, dated Jan. 12, 2015.
Search Report in PCTEP2015072418, dated Nov. 19, 2015.
Written Opinion in EP14188874, dated Mar. 23, 2015, EP.
Written Opinion in EP14188875, dated Mar. 16, 2015.
Written Opinion in EP14188876, dated Mar. 17, 2015.
Written Opinion in PCTEP2015070469, dated Nov. 30, 2015.
Written Opinion in PCTEP2015072315, dated Jan. 2, 2015.
Written Opinion in PCTEP2015072418, dated Nov. 19, 2015.

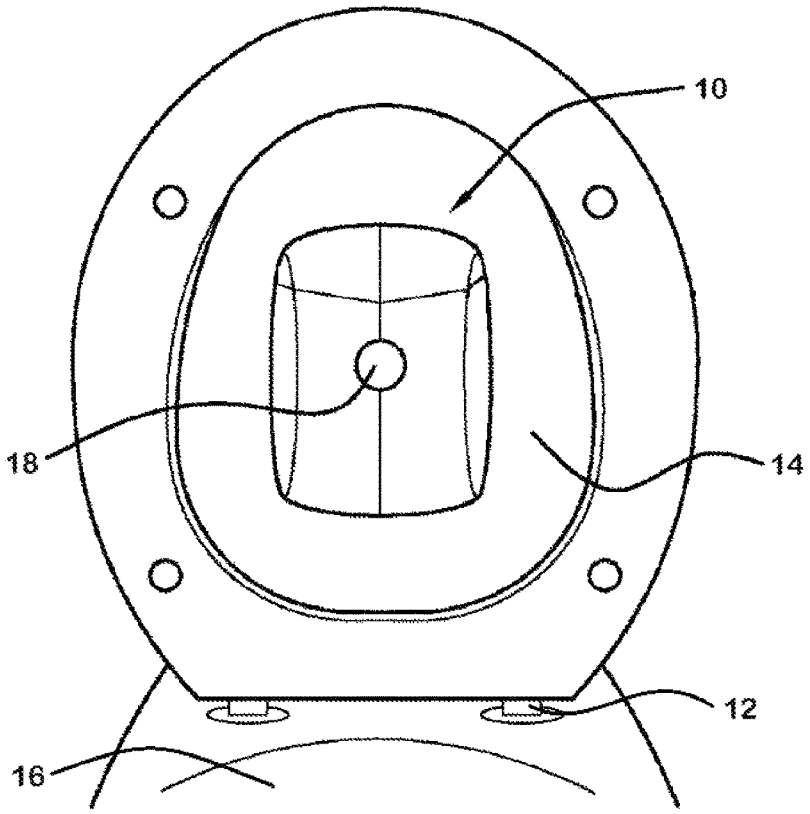
10
18
14
12
16

DEVICE FOR SPRAYING AN ENCLOSURE TRIGGERED BY INCLINATION OF A ROTATABLE LID

FIELD OF THE INVENTION

The present invention relates to a device for spraying an enclosure. In particular, the invention relates to a device to spray a toilet bowl. The invention also relates to a method for operating the device.

BACKGROUND TO THE INVENTION

Cleaning a toilet bowl is a tedious and unpleasant task. However, many toilet users are well aware that toilets can be a source of germs. Such germs may cause malodours and can be hazardous to the health of users of the toilet. Moreover, upon flushing a toilet, aerosols carrying the germs are likely to spread well beyond the toilet bowl. Therefore, a device that can automatically dose a disinfecting composition into the toilet will at least partially relief the user from the task of cleaning the toilet and at the same time provide enhanced hygiene to the toilet bowl and the lavatory.

A similar problem arises with other enclosures that are closable by a lid, such as waste bins and wheelie bins, etc.

Thus, it is very desirable to provide a device that can automatically spray a cleaning or disinfecting liquid into an enclosure. However cleaning and disinfection compositions tend to contain ingredients that may be corrosive or irritant when they come in touch with surfaces for which they were not intended. Thus it is very undesirable, or even dangerous to spray such liquids outside the enclosure, especially if it is a toilet. Therefore, a device designed to automatically spray an enclosure should incorporate a means to detect whether the lid of the enclosure is closed, before the actuation is started. Moreover, it should also be avoided that the device sprays when the lid is opened after actuation has already started, for instance by an inquisitive user or small child, whose curiosity is sparked by the device sitting under the toilet lid, especially if part of its actuation is audible.

A potential solution would be a switch that is pressed when the lid is closed. One of the drawbacks of such a switch is that it requires placement between contacting surfaces of the lid and the confronting part of the enclosure, for instance between the toilet lid and the toilet seat. This puts severe restraints on the design of the device and requires accurate placement by the person installing the device on the enclosure.

Another potential way to detect opening of the lid would be a tilt switch. However, tilt switches are by their nature restricted to switching within a very limited range of angles. Thus they would not be able to reliably detect closing and opening of a lid such as a toilet lid, because we found that there is considerable variation between different toilets in the angles of their lids with respect to the horizontal when the lids are in the closed position. These angles turn out not only to vary between different toilets, but may also vary from one time to another for a given toilet, for instance due to slack in the hinges.

Therefore, there remains a need to improve the safety and reliability of devices for automatically spraying enclosures. In particular there exists such a need with regard to devices for spraying into toilet bowls.

Thus, it is an object of the present invention to improve the safety and reliability of devices for automatically spraying enclosures, especially toilets.

It is another object of the present invention to provide a device for automatically spraying an enclosure that is able to reliably avoid spraying when the lid of the enclosure is open and reliably actuate and spray when the lid is closed, in particular with regard to a toilet bowl.

DEFINITION OF THE INVENTION

We have found that one or more of these objects can be achieved by the device for automatically spraying an enclosure closable by a rotatable lid according to the present invention. The device can be attached to the lid of the enclosure. In operation it can reliably prevent spraying when the lid of the enclosure is opened and equally reliably ensure that the device is actuated to spray into the enclosure when the lid is closed. Thus, the present device reduces the probability of malfunctioning of the device by failing to detect that the lid is properly closed, even when the response of the device (whether or not to actuate and spray) may be subject to further constraints as will become clear below. The device meets one or more of the above objects by virtue of the presence of an electronic control system which includes a tilt sensor in combination with being programmed to exploit the tilt sensor.

Accordingly, in a first aspect the invention provides a device for automatically spraying an enclosure closable by a rotatable lid, wherein the device is attachable to the lid and wherein the device comprises a spraying mechanism suitable for repeatedly spraying individual doses of a cleaning liquid into the interior volume of the enclosure;

an electronic control system which includes a tilt sensor;

wherein the control system is configured to detect the orientation of the device and wherein the control system is programmed to perform the following steps, when the device is attached to the lid of an enclosure:

a) detecting whether the orientation is such that the tilt angle TA remains at a constant value A1 between a first pair of setpoint angles SA1 and SA2 for at least a preset period of time T1;

b) in case the condition of step a is detected:

starting actuation of the spraying mechanism so as to prime said mechanism, or starting actuation of the spraying mechanism so as to spray an individual dose of cleaning liquid into the interior volume of the enclosure, or starting actuation of the spraying mechanism so as to combine said priming and said spraying;

wherein the actuation of the spraying mechanism is interrupted if the tilt angle TA changes to a value outside a first maximum deviation range MDR1;

c) after the device has been primed or actuated, detecting whether the orientation changes such that the tilt angle TA changes to a second constant value A2 between a second pair of setpoint angles SA3 and SA4 and thereupon remains constant for a preset period of time T2;

d) in case the condition of step c is detected progressing to step e;

e) detecting whether the orientation is such that the tilt angle TA remains at a constant angle A3 between a third pair of angles SA5 and SA6 for at least a preset period of time T3, wherein SA5 equals the value of the angle A1 minus a lower tolerance angle LTA and SA6 equals the value of the angle A1 plus an upper tolerance angle UTA;

f) in case the condition of step e is detected, starting actuation of the spraying mechanism so as to spray an individual dose of cleaning liquid into the interior volume of the enclosure wherein the actuation of the spraying mechanism is interrupted if the tilt angle TA changes to a value outside a second maximum deviation range MDR2;

g) optionally repeating steps c to f;

wherein the tilt angle TA is the angle between a local reference direction fixed in the local reference frame of the device and an external reference direction fixed in the reference frame of the enclosure, such that upon attaching the spraying device to the lid, both the local and the external reference direction lie in the plane of rotation of the lid.

The device of the present invention is particularly suited to provided repeated cleaning and/or disinfection to an enclosure. Therefore, according to a second aspect of the invention, there is provided a method for automatically cleaning or disinfecting an enclosure closable by a rotatable lid, the method comprising the following steps:

a. providing a device according to the first aspect of the invention;
b. attaching the device to the inside of the rotatable lid;
c. subsequently closing the lid;
d. subsequently opening the lid;
e. optionally repeating steps c. and d.

A third aspect of the invention is use of a tilt sensor to enhance the safety and/or reliability of a device for spraying an enclosure closable with a rotatable lid.

A fourth aspect of the invention is use of a device according to the first aspect of the invention for safely and reliably spraying a cleaning and/or disinfecting liquid into an enclosure closable by a rotatable lid.

BRIEF DESCRIPTION OF THE DRAWINGS

FIG. 1 illustrates a perspective view of a spraying device connected to a toilet lid.

DETAILED DESCRIPTION OF THE INVENTION

For the avoidance of doubt, any feature of one aspect of the present invention may be utilised in any other aspect of the invention. The word "comprising" is intended to mean "including" but not necessarily "consisting of" or "composed of." Thus, the term "comprising" is meant not to be limiting to any subsequently stated elements but rather to optionally also encompass non-specified elements of major or minor functional importance. In other words, the listed steps or options need not be exhaustive. Whenever the words "including" or "having" are used, these terms are meant to be equivalent to "comprising" as defined above. It is noted that the examples given in the description below are intended to clarify the invention and are not intended to limit the invention to those examples per se.

Except in the examples, or where otherwise explicitly indicated, all numbers in this description indicating amounts of material or conditions of reaction, physical properties of materials and/or use are to be understood as modified by the word "about". Unless specified otherwise, numerical ranges expressed in the format "from x to y" are understood to include x and y. When for a specific feature multiple preferred ranges are described in the format "from x to y", it is understood that all ranges combining the different endpoints are also contemplated.

FIG. 1 illustrates a perspective view of a spraying device 10 connected to a hinged 12 toilet lid 14 for spraying a toilet bowl 16 via a nozzle (not pictured) covered by a nozzle cover 18.

Enclosure

The device according to the invention can be used in any enclosure. The enclosure may be any enclosed space. Here, the term enclosure is not understood to be limited to hermetically closed spaces as will be evident from this description. Preferably, the device is suitable for dispensing a cleanser of disinfectant composition in a sanitary enclosure. Examples of sanitary enclosures include a toilet room, a toilet bowl, a bathroom, a shower cabinet, a sauna. Alternatively it is preferred that the enclosure is a domestic appliance comprising a cleanable internal space, including a washing machine, a mechanical dish washer, and the like. In yet another preferred embodiment, the enclosure is a container for waste, including for example a dustbin or a wheelie bin. It is particularly preferred that the enclosure is a toilet bowl.

The inner volume of the toilet bowl is defined by the space enclosed by the toilet bowl, the water in the bowl, and the toilet lid when the lid is in the closed (lowered) position. Thus, this volume also includes the space under the rim of the toilet, if such a rim is present. The bottom-side of the toilet lid is the side of the lid that faces the inner side of the toilet bowl when it is in its closed (lowered) position.

The enclosure is preferably equipped with a rotatable lid, wherein the lid typically is a hinged lid or otherwise rotatable around an axis parallel to the primary plane of the lid. Since the enclosure preferably is a toilet bowl, the rotatable surface preferably is a toilet lid.

Spraying Device

The first aspect of the invention relates to a device for automatically spraying an enclosure closable by a rotatable lid, wherein the device is attachable to the lid. The device is preferably a device for automatically spraying a toilet bowl. Therefore, the device preferably is attachable to the lid of a toilet bowl. Thus, the spraying device preferably contains means for attaching it to the bottom side of the lid of a toilet. Said means cover any aid, appliance or tool that may be used to secure the device temporarily or permanently to the toilet lid. Non-limiting examples of such means are a layer or drop of adhesive, double-sided sticking tape and Velcro. It is however, also possible to use a clamp, a hook, a screw, a bayonet fitting, a vacuum cup or similar means to attach the device to the lid. Another suitable way of attaching is via a mounting base which is permanently attached to the surface and equipping both the base plate and the device with cooperating, clickable, reversible fastening means. The latter configuration enables easy replacement and/or cleaning of the device and or exchange of consumables, including but not limited to e.g. a cartridge or batteries. Alternatively, a combination of different securing aids, appliances and/or tools might be used.

The device of the present invention comprises a spraying mechanism suitable for repeatedly spraying individual doses of a cleaning liquid into the interior volume of the enclosure. The operation of the device is controlled by an electronic control system.

The spraying mechanism may be any suitable spraying mechanism that is capable of delivering a dose of liquid in spray form into the enclosure. The dosed sprayable liquid typically is a cleaning and/or disinfecting liquid.

In the context of the present invention, cleaning an enclosure is understood to include one or more of cleaning, sanitising and disinfecting of the inner surface of the enclosure as well as cleaning, sanitising and disinfecting of the air contained in the enclosure. Cleaning typically includes efficacy in reducing the amount or the noticeability of any dirt or malodour. Sanitising and disinfection typically include partial or complete inactivation or reduction of microbes.

To this end, the liquid used in the spraying mechanism of this invention preferably comprises at least one compound selected from the group comprising biocides, fragrances, essential oils, surfactants, solubilizers or hydrotropes, colorants and odour immobilisers. The liquid is preferably suitable for providing such cleaning/sanitising/disinfecting efficacy upon spraying in a toilet bowl. Suitable compositions are known in the art.

It is preferred that the device of the invention comprises a liquid spraying mechanism suitable for spraying in a downward direction. In that way, when the enclosure is closed by its lid, and the device is attached to the lid, it sprays into the enclosure and away from the lid.

In order for the device to be suitable for spraying a liquid into the enclosure, it typically comprises means to extract liquid from a stock volume of such liquid. Therefore, the mechanism may for example contain a reservoir or it may be connectable to a reservoir. Thus, the spraying device may for instance be suitable for receiving a cartridge that contains a reservoir for the sprayable liquid, whereby the reservoir is in liquid communication with the spraying mechanism.

The device of the invention typically includes a means capable of delivering a liquid in the enclosure, in the form of fine droplets (i.e. a mist or an aerosol). Typically, this delivery is realised by atomising or nebulising the liquid. The means for extracting and dispensing the liquid, when present, constitute parts of the spraying mechanism of the device. It is preferred that the spraying mechanism also includes means for metering an appropriate dose of cleansing liquid. The spraying mechanism may for example include a positive displacement pump, (e.g. a piston-operated or similar pump) that can perform the extraction, metering and dispensing function. Dispensing typically involves a nozzle or similar aperture. Alternative means of extraction, metering and dispensing are also contemplated. Such alternatives include for example a vibrating mesh spray actuator.

Electronic Control System

It is particularly beneficial if actuation of the spraying mechanism is responsive to the rotary motion of the device that is connected with opening and closing of the lid, since this enables the automated actuation of the device without the need for the user of the enclosure (the toilet) to take any action. Therefore, the actuation of the spraying mechanism is controlled by an electronic control circuit. The control system typically includes a printed circuit board and/or one or more microcontroller units, programmed or programmable to start, interrupt and/or stop actuation of the spraying mechanism in response to stimuli provided by one or more sensors, including a tilt sensor as detailed below.

The electronic control system is suitable for controlling the spray mechanism, but does not have to be limited to that functionality. For example, it can also be capable of actuating a speaker, buzzer or optical signalling means (e.g. an LED), for instance to inform the user that the device is about to be actuated or that the device is running out of cleaner liquid or requires battery replacement.

The electronic control system may suitably also include or be responsive to other switches and/or sensors, for example switches that allow detecting the presence of a liquid cartridge, correct mounting of the device (e.g. by the switch being depressed upon proper mounting), or a sensor/switch to detect the current actuation state of the spraying mechanism.

In order to provide electric power to the control circuit and the actuator, the device can for instance be connectable to an external power source, such as electric mains or an external battery. Preferably, the spraying device is adapted for receiving a removable power source, for example one or more batteries.

Tilt Sensor and Tilt Angle TA

The electronic control system includes a tilt sensor and is configured to detect the orientation of the device.

Thus, the electronic control system typically is capable of responding to an electronic read-out of the tilt sensor by starting, interrupting, or stopping actuation of the spraying mechanism.

The orientation of the device—when mounted to the lid of the enclosure—is conveniently expressed in terms of its tilt angle. Therefore, in the context of this invention, the tilt angle TA is the angle between a local reference direction fixed in the local reference frame of the device and an external reference direction fixed in the reference frame of the enclosure, such that upon attaching the spraying device to the lid, both the local and the external reference direction lie in the plane of rotation of the lid. If the device of the present invention is mounted to the lid of the enclosure, the orientations that particularly matter are those that correspond to the lid being closed, it being fully opened and orientations in between those two. These orientations are all determined by rotation of the lid within the plane of rotation that is determined by its hinged attachment to the enclosure. In principle, the reference directions that are used (within the plane of rotation) are arbitrary, as long as they are consistently used. For example, when the enclosure is a toilet bowl, the toilet lid rests in a plane that is (approximately) horizontal when it is closed and rotates (approximately) in a vertical plane. In that case, a convenient choice for the external reference direction fixed in the reference frame of the enclosure is the upward vertical direction. A suitable local reference direction fixed in the local reference frame of the device is the direction normal to the base plane of the device, the base plane being a plane that is locally parallel to the toilet lid once the device is closed and the normal direction taken to point from the device in the direction of the lid upon attachment of the device to the lid. A suitable choice for the tilt angle TA is then for it to be the acute angle between these two reference directions. With the above choice of reference directions, a tilt angle TA of 0° (degrees) corresponds to the lid being closed, provided the toilet and the lid are mounted perfectly level. The opening of the lid then corresponds to a positive TA and if the lid is pointing straight up, this corresponds to TA=90° (degrees). Therefore, it is preferred that the external reference direction is the upward vertical direction, the local reference direction is normal to the base plane of the device and pointing from the device towards the lid upon attachment thereto and TA is the acute angle between these directions. In other words, it is preferred that TA is the acute angle between the upward vertical direction and the direction normal to the base plane of the device and pointing from the device to the lid upon attachment thereto.

In the context of this application, a tilt sensor is understood as an electronic sensor that can measure tilting of the device. A tilt sensor typically provides an electronically readable signal that correlates to the tilt angle TA, provided it is correctly placed. There is generally no need for either the sensor or any other part of the electronic control system to calculate TA itself, as it generally suffices to base the logic programmed into the control system on the readable signal rather than on the tilt angle TA, as will be clear to the skilled person.

Suitable tilt sensors are well-known electronic components, including but not limited to: electronic inclinometers, accelerometers, gyroscopes, magnetometers, or sensors based on potentiometers, or variable capacitors. A simple tilt switch, such as for instance a simple mercury switch, is not a suitable tilt sensor in the context of the present invention, because such a simple tilt switch can only switch on or off at one particular tilt angle and is not capable of providing an electronic read out that correlates to the tilt angle TA over the range that is typically accessible when the spraying device is in operation.

Tilt sensors that are based on microelectromechanical systems (MEMS) are preferred. Examples of MEMS-based tilt sensors include accelerometers. It is preferred that the tilt sensor is an accelerometer. Accelerometers can be two-axis or three-axis accelerometers. Though both can be used in the present invention, it is preferred that the tilt sensor is a three axis accelerometer.

Tilt sensors as exemplified above are generally capable of measuring the tilt angle in at least one plane of rotation. Certain tilt sensors, in particular three-axis tilt sensors (e.g. three-axis accelerometers) can provide a signal correlating to rotation in any plane of rotation.

A typical example of a suitable three-axis accelerometer would be the KXTJ2-1009 of Kionix.

The electronic control system is configured to detect the orientation of the device. To meet this requirement—in particular in case a tilt sensor is used that can measure tilt in only one plane of rotation—it is important that the tilt sensor is oriented in such a way in the device and the device is oriented in such a way on the lid of the enclosure that the plane of rotation of the toilet lid results in a sufficient change in the electronic output signal of the tilt sensor, as will be understood by the skilled person. For example, with a two-axis accelerometer as the tilt sensor, optimal precision would be achieved if both axes are in the plane of rotation of the toilet lid.

Program

The control system is programmed to perform the below steps. This means that the program may for example be hard-wired into the control system. In terms of engineering efficiency and flexibility, it is preferred that the electronic control system includes a programmable microprocessor. Here, the control system being programmed to perform certain steps is construed to mean that the program provides the functionality of the prescribed steps, yet without the requirement of the program actually defining or using the parameters (angles, times) used to describe the functionality.

Step a)

Step a) involves detecting whether the orientation is such that the tilt angle TA remains at a constant value A1 between a first pair of setpoint angles SA1 and SA2 for at least a preset period of time T1. Here, SA1 and SA2 are preferably selected such that if the lid is stably closed, TA is within the range from SA1 to SA2. Typically, this corresponds to the lid being approximately horizontal. For example, the control system may be programmed such that the range of setpoint angles SA1 to SA2 corresponds to the lid being less than 40 degrees off, preferably less than 30 degrees off and even more preferably less than 20 degrees off with respect to horizontality. The time T1 is preferably selected to be long enough for it to be unlikely that the stable orientation at constant value A1 corresponds to something else than the lid stably resting on the confronting, supporting part of the enclosure. Therefore, in a practical situation, T1 is preferably at least 2 seconds, more preferably T1 is within the range of from 2 to 10 seconds and even more preferably within the range of about 4 to 6 seconds. Thus, the device tolerates being used on different enclosures even though the exact value of A1 is likely to vary between different enclosures of the same type (e.g. different toilet bowls).

Step b)

In case the condition of step a is detected, step b) involves:

starting actuation of the spraying mechanism so as to prime said mechanism, or starting actuation of the spraying mechanism so as to spray an individual dose of cleaning liquid into the interior volume of the enclosure, or starting actuation of the spraying mechanism so as to combine said priming and said spraying.

This step ensures that after the tilt angle TA that corresponds to the lid being closed has been established and the device stays closed, the spraying mechanism is actuated for the first time. Whether the first actuation involves priming or not depends on the configuration of the spraying mechanism, because some such mechanisms require priming, whereas others do not, as is understood by the skilled person. If the spraying mechanism includes a piston-operated positive displacement pump, for example, it will typically require one or more pump cycles to completely fill the spraying mechanism between the reservoir and the nozzle of the system.

During the actuation of step b) the actuation of the spraying mechanism is interrupted if the tilt angle TA changes to a value outside a first maximum deviation range MDR1. This maximum deviation range is preferably chosen such that if the lid is opened sufficiently far—i.e. outside the set maximum deviation range—the spraying mechanism does not continue, but halts. An optimal maximum deviation range may be different for different spraying devices according to the invention. It may for instance depend on the type of enclosure, and is suitably selected such that at least any deliberate movement of the lid leads to interruption of the actuation, thereby enhancing the safety of the device. In a practical example, the lower boundary of the deviation range MDR1 preferably is the value of A1 minus the first lower deviation limit LDL1 and the upper boundary of the deviation range MDR1 is the value of A1 plus the first upper deviation limit UDL1. The upper and lower deviation limits UDL1 and LDL1 are preferably taken as small as possible, taking into account the tolerance of the components of the device and potential slack in the hinged attachment of the lid. The upper and lower deviation limits UDL1 and LDL1 can for instance be independently selected to have a value within a range of from 1 to 20 degrees, preferably from 3 to 18 degrees, more preferably from 5 to 15 degrees and even more preferably between 6 and 12 degrees and even more preferably from 7 to 10 degrees. For programming simplicity, it may be preferred in some instances that the upper deviation limit UDL1 and the lower deviation limits LDL1 have the same magnitude.

The most suitable response of the control system if the lid is closed again may depend on the type of spraying mechanism. Typically, the system will resume the actuation cycle once the tilt angle TA is within the maximum deviation range again. In that case it may be highly desirable if the control system is programmed to wait until the lid is in a stable position long enough for it to be unlikely that it is not closed.

Alternatively, the actuation cycle may restart once the tilt angle TA is within the maximum deviation range again.

Step c)

After the device has been primed or actuated, step c) involves detecting whether the orientation changes such that the tilt angle TA changes to a second constant value A2 between a second pair of setpoint angles SA3 and SA4 and thereupon remains constant for a preset period of time T2. Here, SA3 and SA4 are preferably selected such that if the lid is fully opened, TA is within the range from SA3 to SA4. Typically this corresponds to the lid being rotated to an orientation that is approximately vertical. For example, the control system may be programmed such that the range of setpoint angles SA3 to SA4 corresponds to the lid being rotated to within a range of 65 to 140 degrees, preferably 80 to 120 degrees from horizontality. Therefore, it is preferred that the range spanned by the second set of setpoint angles SA3 and SA4 does not overlap with the range spanned by the first set of setpoint angles SA1 and SA2. The time T2 is preferably selected to be long enough for it to be unlikely that the stable orientation at constant value A2 corresponds to something else than the lid stably resting in its opened position. In case the enclosure is a toilet bowl, it may be preferred that T2 is selected to a time long enough to correspond to the toilet having been used. Therefore, in a practical situation, T2 is preferably at least 1 second, more preferably T2 is within the range of from 1 to 10 seconds and even more preferably within the range of 2 to 6 seconds. Thus, the device tolerates being used on different enclosures even though the exact value of A2 is likely to vary between different enclosures of the same type (e.g. different toilet bowls).

Step d)

Step d) involves progressing to step e) in case the condition of step c) is detected. By virtue of this step, the control system can be programmed to progress to require the lid having been opened long enough in between two actuations.

Step e)

Step e) involves detecting whether the orientation is such that the tilt angle TA remains at a constant angle A3 between a third pair of angles SA5 and SA6 for at least a preset period of time T3 wherein SA5 equals the value of the angle A1 minus a lower tolerance angle LTA and SA6 equals the value of the angle A1 plus an upper tolerance angle UTA.

This step typically corresponds to checking whether the lid of the enclosure is closed again. A closed lid should correspond to a tilt angle TA which is close to the value of A1. However, the exact tilt angle TA may vary (slightly) from time to time, for example due to slack in the attachment of the lid to the enclosure, or the presence or resilient padding between the lid and the confronting surface of the enclosure. Therefore, the upper and lower tolerance angles UTA and LTA allow for some tolerance. The upper and lower tolerance angles UTA and LTA can for instance be independently selected to have a value within a range of from 0.5 to 10 degrees, preferably from 1 to 8 degrees and more preferably between 2 and 6 degrees and even more preferably about 4 degrees. In view of programming efficiency, the upper tolerance angle UTA and the lower tolerance angle LTA may be selected to have the same magnitude.

The time T3 is preferably selected to be long enough for it to be unlikely that the stable orientation at constant value A3 corresponds to something else than the lid stably resting on the confronting, supporting part of the enclosure. Therefore, in a practical situation, T3 is preferably at least 1 second, more preferably T1 is within the range of from 1 to 10 seconds and even more preferably within the range of about 2 to 6 seconds. Thus, the device tolerates being used on an enclosure even though the exact value of A3 is likely to vary somewhat upon opening and reclosing of the lid.

Step f)

In case the condition of step e is detected, step f) involves starting actuation of the spraying mechanism so as to spray an individual dose of cleaning liquid into the interior volume of the enclosure.

In a similar way as in step b), the actuation of the spraying mechanism in step f) is interrupted if the tilt angle TA changes to a value outside a second maximum deviation range MDR2. Like in step b) this second maximum deviation range is preferably chosen such that if the lid is opened sufficiently far—i.e. outside the set maximum deviation range—the spraying mechanism does not continue, but halts. An optimal maximum deviation range may be different for different spraying devices according to the invention. It may for instance depend on the type of enclosure, and is suitably selected such that at least any deliberate movement of the lid leads to interruption of the actuation, thereby enhancing the safety of the device. In practical a example, the lower boundary of the deviation range MDR2 preferably is the value of an angle A4 minus the first lower deviation limit LDL2 and the upper boundary of the deviation range MDR2 is the value of A4 plus the first upper deviation limit UDL2. The angle A4 is suitably selected from A1 and A3, preferably A4 equals A1. The upper and lower deviation limits UDL2 and LDL2 are preferably taken as small as possible, taking into account the tolerance of the components of the device and potential slack in the hinged attachment of the lid. The upper and lower deviation limits UDL2 and LDL2 can for instance be independently selected to have a value within a range of from 1 to 20 degrees, preferably from 3 to 18 degrees, more preferably from 5 to 15 degrees and even more preferably between 6 and 12 degrees and even more preferably from 7 to 10 degrees. For programming simplicity, it may be preferred that the upper deviation limit UDL2 and the lower deviation limits LDL2 have the same magnitude. Furthermore, it may be preferred that UDL2 equals UDL1 and LDL2 equals LDL1.

The most suitable response of the control system if the lid is closed again may depend on the type of spraying mechanism in the same way as described above regarding step b.

Step g)

Step g) involves optionally repeating steps c to f, because in this way the electronic control system—like the spraying mechanism—is suitable for repeatedly spraying individual doses of a cleaning liquid into the interior volume of the enclosure. Whether or not the steps c to f are repeated is suitably made conditional to one or more other parameters relating to the functionality of the device, for instance the battery power level, the amount of liquid still available for spraying or the total number of actuations that has already passed. Step g) itself is suitably also repeated, in other words, the device is typically configured to allow more than two actuations. Thus, for example a typical device according to the invention intended for consumer use, e.g. in a toilet, would be configured to include a reservoir and be programmed such that it enables between 10 and 1000, preferably between 20 and 500, more preferably between 50 and 150 actuations before the reservoir requires refilling or replacing.

Preferred Settings

Combinations of preferred features with regard to the above steps a, b, c, d, e, and f are contemplated too.

In particularly, it is preferred that the electronic control system is programmed such that, when the device is attached to the lid of an enclosure:

SA1 and SA2 are selected such that if the lid is stably closed, TA is within the range from SA1 to SA2;

SA3 and SA4 are selected such that if the lid is fully opened, TA is within the range from SA3 to SA4; and the range spanned by the second set of setpoint angles SA3 and SA4 does not overlap with the range spanned by the first set of setpoint angles SA1 and SA2.

It is more preferred that the electronic control system is programmed such that, when the device is attached to the lid of an enclosure:

SA1 and SA2 are selected such that if the lid is stably closed, TA is within the range from SA1 to SA2;

SA3 and SA4 are selected such that if the lid is fully opened, TA is within the range from SA3 to SA4;

the range spanned by the second set of setpoint angles SA3 and SA4 does not overlap with the range spanned by the first set of setpoint angles SA1 and SA2;

T1 is within the range of from 2 to 10 seconds;

T2 is within the range of from 1 to 10 seconds;

T3 is within the range of from 1 to 10 seconds the lower boundary of the first deviation range MDR1 is the value of A1 minus the first lower deviation limit LDL1 and the upper boundary of the deviation range MDR1 is the value of A1 plus the first upper deviation limit UDL1 the first upper and lower deviation limits UDL1 and LDL1 are independently selected to have a value within a range of from 1 to 20 degrees;

the upper and lower tolerance angles UTA and LTA are independently selected to have a value within a range from 0.5 to 10 degrees;

the lower boundary of the deviation range MDR2 is the value of an angle A4 minus the first lower deviation limit LDL2 and the upper boundary of the deviation range MDR2 is the value of A4 plus the first upper deviation limit UDL2;

the angle A4 is selected from A1 and A3, whereby A4 preferably equals A1; and the second upper and lower deviation limits UDL2 and LDL2 are independently selected to have a value within a range of from 1 to 20 degrees.

The angles of SA1, SA2, SA3, and SA4 that correspond to the lid being closed or open, respectively, depend on the definition of TA. Therefore, it is preferred that:

TA is the acute angle between the upward vertical direction and the direction normal to the base plane of the device and pointing from the device to the lid upon attachment thereto;

SA1 is selected to have a value between −40° (minus 40 degrees) and −5°, more preferably between −30° and −10° and even more preferably between −25° and −15°;

SA2 is selected to have a value between 5° (5 degrees) and 40°, more preferably between 10° and 30° and even more preferably between 15° and 25°;

SA3 is selected to have a value between 60° (60 degrees) and 90°, more preferably between 65° and 80°; and SA4 is selected to have a value between 90° (90 degrees) and 135 degrees, more preferably between 100° and 120°.

It is more preferred that

TA is the acute angle between the upward vertical direction and the direction normal to the base plane of the device and pointing from the device to the lid upon attachment thereto;

SA1 is selected to have a value between −25° and −15°;

SA2 is selected to have a value between 15° and 25°;

SA3 is selected to have a value between 65° and 80°; and

SA4 is selected to have a value between 100° and 140°.

It is even more preferred that

TA is the acute angle between the upward vertical direction and the direction normal to the base plane of the device and pointing from the device to the lid upon attachment thereto;

SA1 is selected to have a value between −25° and −15°;

SA2 is selected to have a value between 15° and 25°;

SA3 is selected to have a value between 65° and 80°;

SA4 is selected to have a value between 100° and 140°;

T1 is within the range of from 2 to 10 seconds;

T2 is within the range of from 1 to 10 seconds;

T3 is within the range of from 1 to 10 seconds the lower boundary of the first deviation range MDR1 is the value of A1 minus the first lower deviation limit LDL1 and the upper boundary of the deviation range MDR1 is the value of A1 plus the first upper deviation limit UDL1 the first upper and lower deviation limits UDL1 and LDL1 are independently selected to have a value within a range of from 5 to 15 degrees;

the upper and lower tolerance angles UTA and LTA are independently selected to have a value within a range from 0.5 to 10 degrees;

the lower boundary of the deviation range MDR2 is the value of an angle A4 minus the first lower deviation limit LDL2 and the upper boundary of the deviation range MDR2 is the value of A4 plus the first upper deviation limit UDL2;

the angle A4 is selected from A1 and A3, whereby A4 preferably equals A1; and the second upper and lower deviation limits UDL2 and LDL2 are independently selected to have a value within a range of from 5 to 15 degrees.

Optional Steps and Processes

The electronic control system may suitably be programmed to perform optional additional steps before, after or between any of the above-specified program steps a) to g). It may also be programmed to run processes in parallel to those program steps.

Thus, actuation of the device may be made subject to the presence of liquid in the reservoir (if any) or the presence of a cartridge containing the liquid and/or the attachment of the device to the lid or a mounting plate. These conditions may suitably be sensed by switches that interrupt an electric circuit once one of these conditions for safe functioning of the device is removed. It may be beneficial if such switches interrupt the main power supply to the electronic control system, thereby preventing any undesired actuations.

The program may suitably incorporate an additional step before step a) in which an orientation corresponding to the lid being fully and stably opened is detected and progression to step a) is made conditional on this orientation having occurred. This would enhance the safety and reliability of the device, because it makes it further less likely that the device is operated without actually having been mounted to the lid of the enclosure. This applies especially if the enclosure is a toilet bowl, since it would be hard for a user to attach the device to the lid without the lid being opened.

This step typically involves detecting whether the orientation changes such that the tilt angle TA changes to a fifth constant value A5 between a fourth pair of setpoint angles SA7 and SA8 and thereupon remains constant for a preset period of time T4. The preferences expressed hereinabove with regard to SA3, SA4 and T2 also apply to SA7, SA8 and T4, respectively, because the function of this step is comparable to that of step c).

A typical cleaning and/or disinfecting liquid may require some contact time on the inner surface of the enclosure in order to obtain optimal performance. In case the enclosure is a toilet, it is typically flushed after use (e.g. for urinating, defecating, emesis or the like). It is desirable to delay actuation of the device, after closing of the lid was detected (e.g. before commencing the actuation of steps b and/or f), until after the flushing. The delay may for example be programmed to last a fixed time interval or to respond to a sensor sensing the flushing.

Several components of the spraying mechanism and or the electronic control system may have a duty cycle that is less than 100%. In other words, several components, or their particular combination in the device, may require a minimum rest period after one or a certain number of actuations, for instance to prevent damage due to overload, overheating, friction, other sources of wear, or run dry (because refilling the spraying mechanism with liquid is not instantaneous). Moreover, if a toilet or other enclosure is intensely used, it may be desirable if the device is not actuated after every opening and reclosing of the lid. Thus, in operation, actuation may be made conditional to the number of actuations that occurred within a given time preceding the present closing of the device. Thus, the number of actuations could for instance be limited to a maximum of a set number between 1 and 20, more preferably between 5 and 15, or even more preferably about 10 actuations within 24 hours. Alternatively or additionally, actuation may be made subject to the condition that the last actuation is at least a certain time ago, for instance at least ten minutes or at least one hour.

The program may also include separate subroutines that are activated in case the power supply is running low (as sensed e.g. by a drop in the voltage). Such subroutines may desirably trigger a warning signal to the user to replace the batteries. In order to save battery life to allow repeatedly instructing the user to replace the batteries, the activation of such a warning signal may suitably be made dependent on the lid having been closed and reopened: Especially if the signal is visual, the user will only be able to see it if the lid is opened. As a further safety feature, the program may activate a further subroutine when the batteries are critically low. Typically, such a subroutine would provide the same warning signal to the user, but would prevent the device from actuation. Thus, a situation in which actuation becomes unpredictable because of power failure is avoided. Similar subroutines may also be provided with regard to the liquid stock still present, for instance by direct sensing of the liquid level or by counting the number of actuations since refilling or replacing the liquid reservoir.

Detecting the Orientation

In order to detect whether the orientation satisfies any of the above-described conditions, or whether it deviates from such a condition, the electronic control system may for instance be programmed to read the signal of the tilt sensor at regular intervals. Typically, these intervals are small with respect to the time scales required for the mechanism to respond to the change of orientation. Suitably, these detection time intervals may be made shorter for detection of changes to the orientation that are more critical to the safe operation of the device. A typical electronic control system could suitably be programmed to detect the orientation at regular intervals, selected from a range of 1 to 100, preferably 5 to 50, and more preferably about 10 microseconds.

Many typical tilt sensors suitable for use in the present device provide a transient or static readable signal that is dependent on the proper acceleration experienced by the sensor. This applies for instance to accelerometers and similar microelectromechanical sensors. When the device is at rest, the proper acceleration corresponds to the direction of the earth's gravitational field and will thus provide a convenient reference for the orientation of the device.

(Accelerated) motion will cause the proper acceleration to deviate from the gravitational acceleration. In particular, motion of the device due to movement of its internal parts may be a source of such noise. Therefore, it is desirable to enable the control system to avoid staggering of the spraying mechanism by cancelling out noise in the signal from the tilt sensor. Such noise typically includes continuous noise—for instance caused by vibrations originating e.g. from an electromotor driving the spraying mechanism or a piezoelectric element—and/or single shock noise, e.g. if the spraying mechanism is piston-operated.

As explained above, certain tilt sensors (in particular tri-axis accelerometers and the like) will also provide electronically readable signals relating to motion and or orientation outside the plane of rotation defined by the hinged attachment of the lid. In order to further enhance the safety and reliability of the device, the control system may suitably be programmed to use such signals e.g. to detect disruptions to the normal opening and closing of the lid and/or misalignment of the device. Such misalignment might for instance occur if the device is designed to be aligned in a particular way with respect to the plane of rotation of the lid of the enclosure, e.g. to allow recharging of the spraying mechanism by virtue of gravity once the lid is opened and closed again.

Method

The method for automatically cleaning or disinfecting an enclosure closable by a rotatable lid according to the second aspect of the invention as defined hereinabove involves providing the device according to the first aspect of the invention.

Consequently, any preferred feature of the device according to the invention is also preferred with regard to this method. In particular, it is preferred that the enclosure is a toilet bowl.

Use of a Tilt Sensor

According to the third aspect, the invention provides use of a tilt sensor to enhance the safety and/or reliability of a device for spraying an enclosure closable with a rotatable lid. The enhanced safety and/or reliability of the device are suitably provided by virtue of the functionality that is enabled by the presence of a tilt sensor in such a device as explained with regard to the device according to the present invention. Thus, use to enhance the safety may include for instance use to avoid or at least reduce the probability of the device inadvertently spraying outside the enclosure. It may particularly include avoiding or at least reducing the probability of the device spraying on a user, a child, a garment, or a pet. Thus, enhanced safety also includes reducing the probability that the device fails to detect that the lid is being moved, especially including when the device is about to spray the liquid. Enhanced reliability includes reducing the probability that the device does not spray the enclosure when it is supposed to do so (e.g. after the lid of the enclosure has been closed and possibly other conditions are fulfilled too), for instance by reducing the probability that the device fails to detect that the lid has been closed or opened.

Preferably, this use of a tilt sensor relates to use wherein the enclosure is a toilet bowl. The tilt sensor preferably is an accelerometer as described hereinabove.

The present use of a tilt sensor is particularly advantageous if it relates to use wherein the device is attachable to the lid and wherein the device comprises a spraying mechanism suitable for repeatedly spraying individual doses of a cleaning liquid into the interior volume of the enclosure.

The present use of a tilt sensor is facilitated by the presence of an electronic control system in the device. Therefore, this use preferably relates to use wherein the device comprises an electronic control system which includes the tilt sensor. It is even more preferred that the control system is configured to detect the orientation of the device. It is particularly preferred that the control system is programmed to perform the steps as specified with regard to the device according to the first aspect of the invention.

The present use of a tilt sensor preferably relates to use, wherein the device is a device according to the first aspect of the invention. Any feature preferred with regard to the device of the first aspect of the invention is therefore also preferred for the device to which the present use of tilt sensor relates.

Use of the Device

According to the fourth aspect of the invention there is provided use of a device according to the first aspect of the invention for safely and reliably spraying a cleaning and/or disinfecting liquid into an enclosure closable by a rotatable lid. The advantages of the device according to the present invention with regard to its safe and reliable performance have suitably been described hereinabove. The present use of a device preferably relates to use wherein the enclosure is a toilet bowl. Any feature preferred with regard to the device of the first aspect of the invention is therefore also preferred for the present use of the said device.

Preferred Device

In some embodiments, the device of the invention may be further enhanced by combining the above features with further optional features as explained below.

It is preferred that the device is a compact spraying device connectable to a surface and for spraying a fluid, wherein the device comprises a housing with an inlet, a pump in fluid communication with the inlet, a retractable nozzle in fluid communication with the pump, a nozzle cover and a drive system. In this embodiment, the retractable nozzle selectively extends forward relative to a front side of the housing into a spraying position for spraying the fluid and retracts inside the housing to a retracted position when not spraying. The nozzle cover is selectively moveable from a closed position in which the cover covers the nozzle when the nozzle is in a retracted position, to an open position in which the cover moves to allow the nozzle to extend into the spraying position. The drive system moves the retractable nozzle and the nozzle cover and operates the pump. The movements of the nozzle and nozzle cover and the operation of the pump can be simultaneous or at least partially simultaneous.

The spraying device according to this embodiment provides a compact system which can be connected to another surface to spray a fluid which can be used for cleaning, deodorizing, disinfecting and/or sanitizing an area or a surface. The compact design allows it to be used with standard products, for example with a standard toilet, attaching it to the toilet lid for spraying into the toilet bowl. The retractable nozzle and nozzle cover allow for a wide spray angle and for protecting against leakage and/or residual fluid on the nozzle coming into contact with something else. This could be useful if a vortex nozzle were used to produce a wide angle spray. The drive system being able to simultaneously move the nozzle, cover and operate the pump makes for a compact system with minimal moving parts, contributing to the overall efficiency and reliability of the system. Such a system can also contribute to the cleanliness and/or safety of the system in certain applications. For example, when used as a consumer device and the fluid contains chemicals or other ingredients which could be harmful to skin or clothing, the retractable nozzle and nozzle cover ensure that the fluid does not come into contact with skin, clothing or other items that could be stained and/or damaged by the fluid.

Optionally, the spraying device of this embodiment further comprises a reservoir for containing the fluid. The reservoir is in fluid communication with the inlet of the housing. Such a reservoir provides an easily refillable and/or replaceable source of fluid for the spraying device. This contributes to ease of use, as the reservoir and housing combine into a compact spraying device which does not require additional external fluid sources connected for operation.

Optionally, the housing comprises a mounting portion for the reservoir. The mounting portion can contribute to the ease of use, allowing for a reservoir to be easily secured to the housing and having features to ensure proper orientation of reservoir and housing.

Optionally, the drive system comprises a gear train configured to move the retractable nozzle and the nozzle cover; a motor for driving the gear train; and a power supply for powering the motor.

Optionally, the gear train is configured to operate the pump to send pressurized fluid to the nozzle when the nozzle is in the spraying position.

Optionally, the electronic control system of the device is configured to control the drive system. Optionally, the control system comprises one or more sensors which signal when to move the cover and retractable nozzle into a spraying position and to operate the pump.

Such a control system allows the spraying device to be able to function automatically without the need for a user to manually trigger the start of a spraying operation. One or more sensors can indicate to the control system that a spraying operation is needed. When the device is actuated to spray, the control system can then send a signal to the drive system to operate the pump, move the cover to an open position and extend the nozzle into a spraying position. When the fluid is discharged through the nozzle, the control system can then signal to the drive system to retract the nozzle, move the cover to a closed position and power down the pump. The spraying device can then be in a stand-by or rest mode, and await another triggering event. The control system can monitor and control all these operations and/or send signals for the actuations and movements simultaneously, and it does not have to be in the order set out here. For example, the control system could control the operation as one cycle consisting of opening the cover, extending the nozzle, spraying, retracting the nozzle and closing the cover. The control system can also monitor other conditions, such as battery life, intermediate movements and other conditions to ensure system is working properly and prevent dangerous situations.

Optionally, the nozzle cover slides between the open position and the closed position. Further optionally, this movement is done using a scotch yoke mechanism and is driven by the drive system.

Optionally, the nozzle cover comprises a face portion which covers the nozzle in the closed position and moves to allow the nozzle to extend in the open position; first and second rails connected to the face portion; and a slot for receiving a pin which moves the cover along the first and second tracks. The first and second rails are positioned to slide along first and second tracks in the device to guide the movement of the cover.

Optionally, the nozzle cover further comprises a first slot on the first rail to receive a first projection connected to the nozzle; and a second slot on the second rail to receive a second projection connected to the nozzle. The first slot and the second slot are shaped so that the nozzle moves into the spraying position as cover moves into the open position and so that the nozzle moves into the retracted position when cover moves into the closed position. Optionally, the first projection and the second projection can include a broad portion and a smaller portion. The broad portion can be for steadying the nozzle and keeping it properly positioned, and the smaller portion can be the portion which is received by the slot. Optionally, the smaller portion can be cylindrical which can enable easy sliding movement.

Optionally, one of the nozzle cover and the nozzle are configured to be driven by the drive system. The other of the nozzle cover and the nozzle are configured to be driven by the movement of the one driven by the drive system. This can mean that the nozzle cover is driven by the drive system and the nozzle is configured to be driven by the movement of the nozzle cover. Conversely, the nozzle could be driven by the drive system and the nozzle cover could be configured to be driven by the movement of the nozzle.

Such systems which connect the movement of the nozzle and nozzle cover, having only one driven by the drive system can make for a more reliable system and ensure that the nozzle cover and nozzle move simultaneously. Additionally, configuring the nozzle and nozzle cover so that only one is driven by the drive system and the other is driven by the movement of the first one can result in a overall more compact system.

Optionally, the spraying device further comprises a mounting system for connecting the back side of the housing to a surface. A mounting system can enable easy and secure attachment of the spraying device to another surface.

Optionally, the mounting system comprises a mounting plate with a first side for connecting to a surface and a second side for connecting to the housing of the spraying device; and one or more guides to guide and/or secure the housing to the mounting plate. Further optionally, the mounting system further comprises a locking feature to secure the housing to the mounting plate. Such a mounting system could be designed to ensure spraying device is properly oriented for operation when connected to the mounting plate.

Optionally, the spraying device further comprises a safety switch for disabling the spraying device when the housing is not secured to the mounting plate. This can ensure that the spraying device does not perform a spraying operation when not desired, preventing accidental trigger of a spraying operation.

Optionally, the spraying device is a toilet spraying device for mounting to a lid of a toilet.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the appended claims.

The invention claimed is:

1. Device for automatically spraying an enclosure closable by a rotatable lid, wherein the device is attachable to the lid, wherein the device is designed to spray the enclosure when the lid is closed and wherein the device comprises:

A. a spraying mechanism suitable for repeatedly spraying individual doses of a cleaning liquid into the interior volume of the enclosure; and B. an electronic control system which includes a tilt sensor;

wherein the control system and tilt sensor of (b) are configured to detect the orientation of the device and wherein the control system is programmed to perform the following steps, when the device is attached to the lid of an enclosure:

a) detecting whether the orientation of the device is such that the tilt angle TA remains at a constant value A1 between a first pair of setpoint angles SA1 and SA2 for at least a preset period of time T1;

b) in case the condition of step a is detected:

i. starting actuation of the spraying mechanism so as to prime said mechanism, or ii. starting actuation of the spraying mechanism so as to spray an individual dose of cleaning liquid into the interior volume of the enclosure, or iii. starting actuation of the spraying mechanism so as to combine said priming and said spraying;

wherein the actuation of the spraying mechanism of (A) is interrupted if the tilt angle TA changes to a value outside a first maximum deviation range MDR1;

c) after the device has been primed or actuated, detecting whether the orientation changes such that the tilt angle TA changes to a second constant value A2 between a second pair of setpoint angles SA3 and SA4 and thereupon remains constant for a preset period of time T2;

d) in case the condition of step c is detected progressing to step e;

e) detecting whether the orientation is such that the tilt angle TA remains at a constant angle A3 between a third pair of angles SA5 and SA6 for at least a preset period of time T3, wherein SA5 equals the value of the angle Al minus a lower tolerance angle LTA and SA6 equals the value of the angle Al plus an upper tolerance angle UTA;

f) in case the condition of step e is detected, starting actuation of the spraying mechanism so as to spray an individual dose of cleaning liquid into the interior volume of the enclosure wherein the actuation of the spraying mechanism is interrupted if the tilt angle TA changes to a value outside a second maximum deviation range MDR2;

g) optionally repeating steps c to f;

wherein the tilt angle TA is the angle between a local reference direction fixed in the local reference frame of the device and an external reference direction fixed in the reference frame of the enclosure, such that upon attaching the spraying device to the lid, both the local and the external reference direction lie in the plane of rotation of the lid.

2. Device according to claim 1, wherein the enclosure is a toilet bowl.

3. Device according to claim 1, wherein the tilt sensor is selected from an electronic inclinometer, a two-axis accelerometer and three-axis accelerometer.

4. Device according to claim 3, wherein the tilt sensor is a three-axis accelerometer.

5. Device according to claim 1, wherein the electronic control system is programmed such that, when the device is attached to the lid of an enclosure:

a) SA1 and SA2 are selected such that, if the lid is stably closed, TA is within the range from SA1 to SA2;

b) SA3 and SA4 are selected such that, if the lid is fully opened, TA is within the range from SA3 to SA4; and c) the range spanned by the second set of setpoint angles SA3 and SA4 does not overlap with the range spanned by the first set of setpoint angles SA1 and SA2.

6. Device according to claim 1, wherein the tilt angle is the acute angle between the upward vertical direction and the normal to the base plane of the device and pointing from the device to the lid upon attachment thereto.

7. Device according to claim 6, wherein:

a) SA1 is selected to have a value between −40° and −5°;

b) SA2 is selected to have a value between 5° and 40°;

c) SA3 is selected to have a value between 60° and 90° ; and d) SA4 is selected to have a value between 90° and 135°.

8. Device according to claim 1, wherein:

a) T1 is within the range of from 2 to 10 seconds;

b) T2 is within the range of from 1 to 10 seconds;

c) T3 is within the range of from 1 to 10 seconds d)the lower boundary of the first deviation range MDR1 is the value of Al minus the first lower deviation limit LDL1 and the upper boundary of the deviation range MDR1 is the value of Al plus the first upper deviation limit UDL1 e) the first upper and lower deviation limits UDL1 and LDL1 are independently selected to have a value within a range of from 5 to 15 degrees;

f) the upper and lower tolerance angles UTA and LTA are independently selected to have a value within a range from 0.5 to 10 degrees;

g) the lower boundary of the deviation range MDR2 is the value of an angle A4 minus the first lower deviation limit LDL2 and the upper boundary of the deviation range MDR2 is the value of A4 plus the first upper deviation limit UDL2;

h) the angle A4 is selected from Al and A3, whereby A4 preferably equals Al; and i) the second upper and lower deviation limits UDL2 and LDL2 are independently selected to have a value within a range of from 5 to 15 degrees.

9. Method for automatically cleaning or disinfecting an enclosure closable by a rotatable lid, the method comprising the following steps:

a. providing a device according to claim 1;

b. attaching the device to the inside of the rotatable lid;

c. subsequently closing the lid;

d. subsequently opening the lid;

e. optionally repeating steps c. and d.

10. Use of a device according to claim 1 for safely and reliably spraying a cleaning and/or disinfecting liquid into an enclosure closable by a rotatable lid.

* * * * *